United States Patent [19]

Scholz

[11] 4,378,723

[45] Apr. 5, 1983

[54] STRING TUNING AND FASTENING ARRANGEMENT

[76] Inventor: Donald T. Scholz, 13 Rich Valley Rd., Wayland, Mass. 01778

[21] Appl. No.: 259,248

[22] Filed: Apr. 30, 1981

[51] Int. Cl.[3] ..... G10D 3/14

[52] U.S. Cl. ..... 84/297 R; 84/205; 84/312 R

[58] Field of Search ..... 84/200, 205–207, 84/297 R, 312 R, 312 P, 201–204, 208, 282, 318

[56] References Cited

U.S. PATENT DOCUMENTS 475,674 5/1892 Cook ..... 84/297 R 2,201,869 5/1940 Nickel ..... 84/297 R 4,141,271 2/1979 Mullen ..... 84/312 P

*Primary Examiner*—Lawrence R. Franklin

*Attorney, Agent, or Firm*—Wolf, Greenfield & Sacks

[57] ABSTRACT

A stringed musical instrument has separate members commonly mounted at the head of the instrument for providing individual support and adjustment for each of the strings. Each fastening and tuning member comprises an elongated support piece carrying a clamping member that engages and clamps the string with the clamping action increasing as the string is tensioned. The tension is adjusted for tuning purposes by longitudinally displacing the elongated support piece. In the preferred embodiment, the clamping member is a slidable button operating on a forced wedge principle.

12 Claims, 6 Drawing Figures

STRING TUNING AND FASTENING ARRANGEMENT

BACKGROUND OF THE INVENTION

The present invention relates in general to stringed musical instruments and pertains, more particularly, to an improved string tuning and fastening apparatus preferably employed at the head of the stringed instrument and for providing both improved clamping of each string individually, and improved fine adjustment of the tension of each string individually.

In a conventional guitar or other string instrument, the adjustment of the strings is usually accomplished at the head of the instrument and this adjustment means usually comprises a series of pegs or keys which are rotatable for individually varying the tension on each string. The peg typically has a hole through which the string must be passed and tied. However, the problem is that the string tends to slip on the peg and there is usually a need for continuous adjustment of the individual strings. Furthermore, with the conventional arrangement, each of the strings is tied to its associated peg or key at a relatively long distance from the instrument nut and there is a bending of the string near the peg or key. This is undesirable in that there may well be unequal tensions in the string on opposite sides of the nut due to friction at the nut. In accordance with the present invention it is preferred to have the clamping of the string occur by an improved clamping member wherein the clamping occurs relatively close to the nut with each string being clamped so as to cause little or no bending of the string near the clamp.

Accordingly, one object of the present invention is to provide an improved fastening and tuning arrangement for use with a stringed musical instrument and which alleviates the prior art problems typically associated with the use of a conventional adjusting lug, peg or key.

Another object of the present invention is to provide an improved tuning and securing member characterized by an improved clamping wedge that provides clamping along a short segment of the string close to the nut. This "short segment" clamping concept is employed preferably in accordance with the present invention in combination with a means for longitudinally displacing the clamping member such as by the use of an elongated support piece for carrying the clamping member. Also, in accordance with the invention the clamping member preferably tightens on a forced-wedge principle as the tension is increased to automatically increase the locking force of the member to the associated string.

Various types of tuning, adjusting, and securing members are disclosed in such prior art patents as Leger U.S. Pat. No. 3,596,552; Walder U.S. Pat. No. 2,241,284; Jauch U.S. Pat. No. 2,322,137; Oettinger U.S. Pat. No. 1,431,250; Schlemmer U.S. Pat. No. 974,095; and Smith, et al U.S. Pat. No. 3,407,696. These patents all typically show string support means that employ some type of a pivot arrangement. For example, see the Oettinger and Jauch patents. It does not appear from any of these prior art patents that they teach the concept of the present invention of longitudinally clamping the string without causing bending in the tensioned portion of the string, particularly in combination with the longitudinal movement of the clamping mechanism to provide fine tuning. Furthermore, many of these patents teach an adjusting feature, not at the head of the instrument but instead at the base of the instrument. It is noted that in both the Jauch and Oettinger patents that the adjustment is provided at the body of the instrument and not at the fingerboard end.

Thus, another object in accordance with the present invention is to provide an individual string tuning member adapted for replacement of conventional tuning pegs and the like mounted at the head of the instrument and wherein each of the strings is longitudinally clamped at a position closely adjacent to the nut of the instrument.

SUMMARY OF THE INVENTION

To accomplish the foregoing and other objects of this invention, there is provided a fastening and tuning apparatus comprising a support base secured to the head of the instrument and adapted to carry a plurality of separate adjusting means corresponding in number to the number of strings of the stringed instrument. Each fastening and adjusting means comprises an elongated support piece which in turn carries a clamping member supported on the elongated support piece. The clamping member preferably comprises an actuating button supported with a slide member with the actuating button being wedged against the slide member which in turn clamps against the string. The actuating button operates on a wedge principle and a spring is disposed between the actuating button and the slide member to return these two components to a start position when the components are released. The string adjustment or tuning is accomplished by means of a separate manually adjustable means for providing the fine longitudinal displacement of the elongated support piece. In one embodiment, the manually adjustable means is in the form of a lead screw with a thumb wheel.

In accordance with the invention the strings are each individually clamped at approximately the same distance from the nut of the instrument. Because the nut represents the primary support surface, it is preferred to have the clamping occur as close to the nut as possible.

Thus, there are basically two factors that are important in minimizing the bending action of the string. First, it is preferred to make the distance between the nut and where the string is clamped as short as possible so as to keep the stretching of the string to a minimum particularly between those two points. Secondly, to eliminate problems associated with winding the string around a peg or the like, in accordance with the present invention the string is maintained at a straight line behind the nut and is clamped in this straight line position. In accordance with the preferred embodiment, the clamping member operates on a wedge principle so that as the string is tensioned, the clamping action and clamping force is increased.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

FIGS. 1-6 show the preferred construction of the present invention employing a novel clamping member adapted for the clamping of the string of the musical instrument along a segment of its length, in combination with the longitudinal movement of the support piece for the clamp member. Although the concepts of the invention are described in connection with a guitar, it is understood that these principles may also be applied to other stringed musical instruments.

Figure 1:
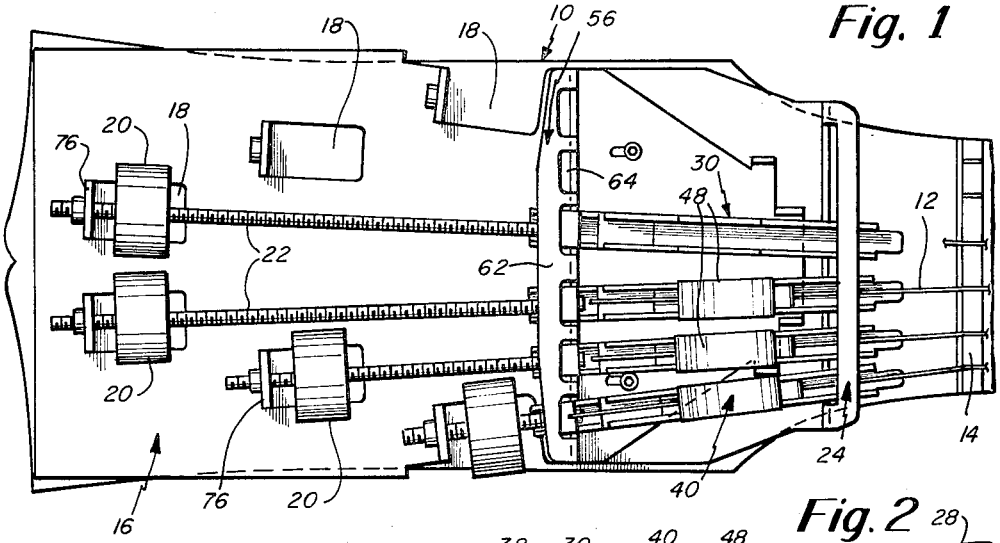
FIG. 1 is a plan view of the head of a stringed musical instrument such as a guitar showing the tuning and fastening apparatus of this invention.

FIG. 1 shows a fragment of a musical instrument particularly including the head 10 wherein, in a conventional guitar, the tuning pegs or keys are supported. In place of this conventional arrangement is the apparatus described in FIGS. 1-6. FIG. 1 also shows a plurality of strings 12 each of which is supported, usually in a fixed position at the body end of the instrument. Each of these strings also pass over the support nut 14 and each is individually secured in the improved fastening and tuning arrangement of this invention. In the case of a six string instrument as depicted in FIG. 1, there are of course, six separate adjusting means, one corresponding to each of the strings. In order to simplify the description herein, one adjusting means is described in detail, the others being substantially identical with the exception of the placement of the thumbwheels, and the more elongated lead screws associated therewith as clearly depicted in FIG. 1.

The apparatus of this invention comprises a common support base 16 having a plurality of cut-outs 18 for accommodating the thumbwheels 20. Each of the thumbwheels 20 is manually engaged by the instrument player to rotate the corresponding lead screw 22. The support base 16 is preferably of a shape corresponding substantially to the shape of the head 10 of the instrument.

Figure 3:
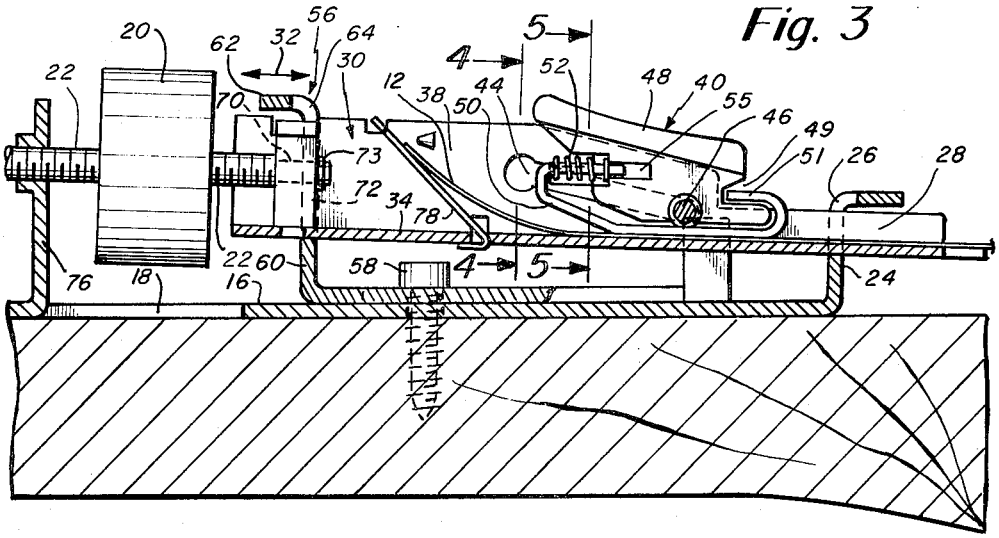
FIG. 3 is a cross-sectional view as taken along line 3—3 of FIG. 2 showing in particular the clamping member carried on the elongated support piece.
Figure 4:
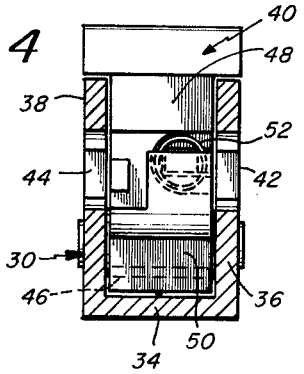
FIG. 4 is a cross-sectional view taken along line 4—4 of FIG. 3.
Figure 5:
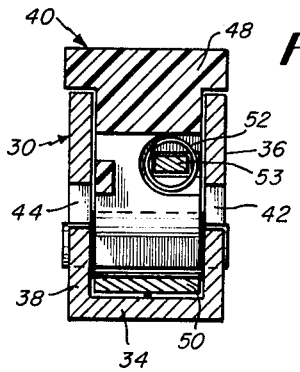
FIG. 5 is a cross-sectional view taken along line 5—5 of FIG. 3.

At the forward end of the support base 16 there is provided an upwardly stepped section 24 having a plurality of slots 26, as depicted in FIGS. 1 and 3, arranged substantially in line with each other transversely across the section 24. Each of these slots 26 receives a finger 28 extending from the elongated support piece 30. The finger 28 forms a guide for restricting the piece 30 to longitudinal displacement substantially in line with the string 12. In FIG. 3 the arrow 32 indicates the general direction of movement of the support piece 30. FIG. 3 also shows the finger 28 in the slot 26 forming a guide means for the piece 30.

The elongated support piece 30 comprises a base 34 which extends into the finger 28, and upright walls 36 and 38 extending from the base and essentially forming a channel for receiving, inter alia the clamping member 40. The clamping occurs on a forced-wedge principle with the string 12 being essentially sandwiched between the clamping member and the base 34. It is also noted particularly in FIG. 6, that the clamping or securing occurs along a segment 12A of the string 12.

Figure 6:
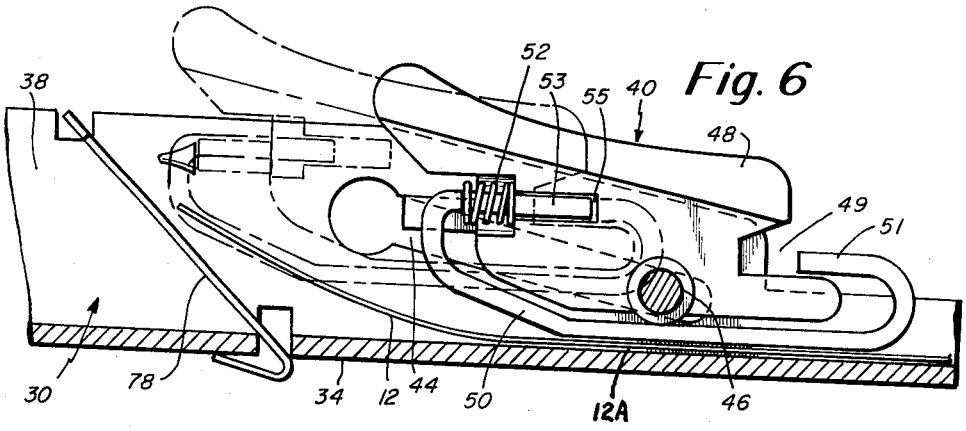
FIG. 6 is a fragmentary enlarged view, similar to the view of FIG. 3 and showing the clamping action.

The upright walls 36 and 38 have respective slots 42 and 44 extending as illustrated in particular in FIGS. 3 and 6 angularly to the base 34. These elongated slots carry a pin 46 which slidably supports a wedge member 40 in the channel defined in the support piece 30.

The wedge member 40, as indicated previously, operates on a wedge principle and includes a plastic or the like actuating button 48, a metal slide 50, and spring 52. The button 48 has a front slot 49 for receiving one end 51 of the metal slide 50. The rear end 53 of the metal slide is received in a rear slot 55 of the button 48. The spring 52 biases the slide bar 50 so that its ends 53 is extending out of the slot 55 such as in the position shown in FIG. 3. At the same time the end 51 of the slide is substantially fully into the front slot 49 of the actuating button. On the other hand, FIG. 6 shows the relationship between the button 48 and the slide 50 in the fully clamped position of the cam member.

A common guide member 56 is supported from the support base 16. FIG. 3 shows one of a plurality of securing bolts or studs 58 that extend both through member 56 and support base 16 into the instrument. There are preferably six bolts that form the main securing means of the apparatus to the istrument. The guide member 56 includes an upright wall 60 and a top wall 62 overlying the rear section of the elongated support piece 30. The walls 60 and 62 are provided with six apertures 64 through which the elongated support piece extends. The upper wall 62 forms an upper limit guiding the support piece 30.

Figure 2:
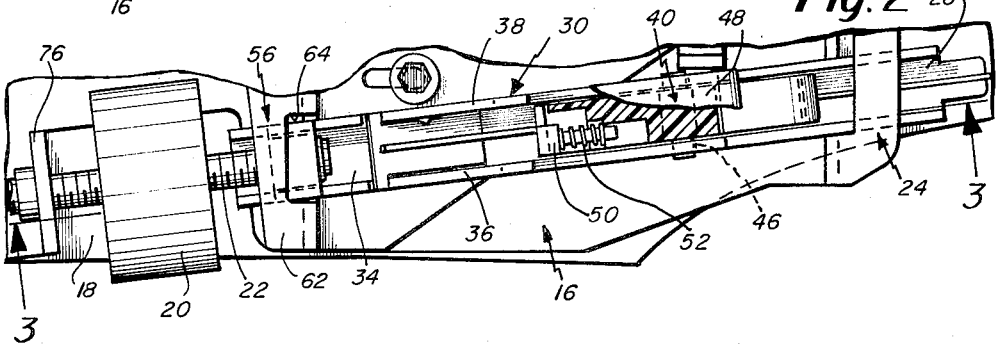
FIG. 2 is an enlarged view showing the tuning and fastening arrangement for a single string.

The cam support piece 30 is moved in the direction of arrow 32 by means of a combination of a lead screw 22 and the thumbwheel 20. The drawing shows the full end of the lead screw 22 having a reduced diameter section 70 which passes through upright wall 72 of the support piece 30. The lead screw may be secured to the wall 72 by means of a lock ring 73. The lead screw 22 is permitted to rotate relative to the upright wall 72. The longitudinal movement of the support piece 30 occurs by means of rotation of the lead screw 22 at the thumbwheel 20. In this regard, the thumbwheel 20 is securely fastened or keyed to the lead screw 22. The rear end of the lead screw 22 passes through retaining block 76 as shown in FIGS. 1-3. Block 76 extends from the support base 16 and has an internally threaded aperture for receiving the lead screw. Other stops may be provided such as ones associated with the knob or wheel to stop it from turning past a predetermined rotation position. At the very rear of the lead screw there may be provided a stop, not shown in the drawing.

When a string 12 is to be replaced, the actuating button 48 may be moved to the position shown in phantom in FIG. 6. FIG. 6 also shows the end of the string 12 passing under the clamping member and hitting against the deflection plate 78. This plate 78 is suitably secured in the elongated support piece 30. FIG. 3 also shows the string 12 extending guided by the plate 78. FIG. 6 shows in solid, the position of the cam member when it is locked to the string. It is noted that in this position the spring 52 is compressed and the slide member is moved forwardly relative to the plastic actuating button 48. The string may be pulled by hand as it extends up along the deflection plate 78, until it is relatively taut. The button 48 which carries the pin 46 which is rotatable within the button 48, is then moved forwardly with some force by hand to urge the slide member 50 against the string 12. The pin 46 rides down the guideways or slots in the side walls of the elongated piece 30. These slots are inclined as clearly indicated in FIGS. 3 and 6 to provide a tightening wedge action. The pin 46 may slightly rotate as the button is depressed and as the elongated piece is moved to tighten the string. As the tension is increased by translation of the elongated piece 30, there is movement of the metal slide member 50 relative to the plastic actuating button 48. Prior to this movement, the spring 52 is in its maximum length position, but as the elongated piece 30 moves, the spring is compressed at least partially and there is slight relative movement between the actuating button 48 and the slide member 50. This locks the metal slide member tightly against the string 12. The more that the elongated piece is moved, the tighter the wedging action becomes between the cam member and the elongated support piece therefor.

When the tension is to be released, the elongated support piece is moved forwardly so that the tension is taken off of the string 12. However, the cam member is still locked to the spring due to the wedging action of the pin and the associated components including the slide member 50. The button may then be moved by hand to release contact between the rigid slide member 50 and the string. For example, the button may be moved from the position shown in solid in FIG. 6 to the position shown in phantom. This manual movement of the actuating button 48 releases the pin 46 so that it progresses up its guide slots. The spring 52 returns the slide member to its start position relative to the plastic actuating button 48, with the spring 52 again in its fully extended position as shown in FIG. 3.

Having described one embodiment of the present invention, it should now be apparent to those skilled in the art that numerous other embodiments are contemplated as falling within the scope of this invention. For example, the concept of this invention may be applied to other stringed instruments having fewer or greater than six strings as depicted herein. Furthermore, the apparatus of this invention may be constructed in, for example, metal or plastic or any other suitably rigid materials. Also, in accordance with the present invention it has been found that preferably all clamping occurs at substantially the same distance from the nut. It is preferred that this clamping occur within 2" of the nut and in one embodiment is at about 1½" from the nut.

In another alternate embodiment of the present invention the combined function of clamping and longitudinal adjustment can be separated. Thus, for example, the clamping may occur in the manner described in FIG. 1 at the head of the neck with the adjustment for longitudinal movement of the string occurring at the body end of the instrument. Alternatively, the longitudinal adjustment may occur at the head of the neck while the wedge member for clamping the string may be at the body end of the instrument. In either instance basically the same structures can be used as described in FIGS. 1–6. Thus, for the example wherein the wedge member is at the body end, the wedge arrangement shown in the drawing may be employed in association with a stationary clamping plate thereunder. At the neck end of the instrument then the string can be secured with the use of the usual ball end of the string in a holder. In that instance then the longitudinal displacement structure shown in the drawing may be used in substance to move the string longitudinally at the neck end of the instrument.

What is claimed is:

1. Fastening and tuning apparatus for a stringed musical instrument comprising:

a support base, means for securing the support base to the instrument, a clamping member, a support piece for carrying said clamping member, and manual tuning means coupled to and for longitudinally displacing said support piece to increase and decrease string tension to thereby tune said stringed musical instrument, said clamping member comprising a wedge member constrained to move linearly along an inclined plane toward the base of the support piece to wedge the string against the base of the support piece.

2. Apparatus as set forth in claim 1 wherein said manual adjusting means includes a lead screw and associated thumbwheel for longitudinally displacing said elongated support piece.

3. Apparatus as set forth in claim 1 wherein said support piece is elongated and of channel shape to accommodate therein said clamping member.

4. Apparatus as set forth in claim 1 including guide means for said support piece.

5. Apparatus as set forth in claim 1 wherein said clamping member provides string contact along a segment thereof and in a way so as to provide little or no bending of the tensioned portion of the string by the clamping member and wherein said support piece which carries said clamping member moves substantially longitudinally in the direction of said string with clamping occurring in close proximity to the nut.

6. Apparatus as set forth in claim 1 wherein said clamping member comprises an actuating body carrying therebelow, a roller and a slide member, said roller disposed between said actuating body and slide member and adapted for angular motion relative to said support piece base.

7. Apparatus as set forth in claim 6 wherein said actuating body and slide member are permitted slight relative movement.

8. Apparatus as set forth in claim 7 including a biasing spring disposed between said actuating and slide member to return them to an initial relative position.

9. Apparatus as set forth in claim 8 wherein said actuating body is supported in a channel defined in said support piece by pin means.

10. Apparatus as set forth in claim 6 wherein said support piece has a base and spaced upright walls extending from the base and forming a channel for receiving the clamping member.

11. Apparatus as set forth in claim 10 wherein the upright walls each have an angled slot for receiving ends of the roller.

12. Apparatus as set forth in claim 11 wherein the slide member is under the actuating member and slides relative thereto to force the roller under pressure against the angled slots and against the slide member to secure the string.

* * * * *